United States Patent [19]

Tholander

[11] Patent Number: 4,595,039

[45] Date of Patent: Jun. 17, 1986

[54] METHOD AND DEVICE FOR CONTROLLING A PLURALITY OF RELAY NOZZLES IN A JET WEAVING MACHINE

[75] Inventor: Lars H. G. Tholander, Huskvarna, Sweden

[73] Assignee: Aktiebolaget Iro, Ulricehamn, Sweden

[21] Appl. No.: 641,900

[22] PCT Filed: Dec. 12, 1983

[86] PCT No.: PCT/SE83/00446

§ 371 Date: Aug. 8, 1984

§ 102(e) Date: Aug. 8, 1984

[87] PCT Pub. No.: WO84/02360

PCT Pub. Date: Jun. 12, 1984

[30] Foreign Application Priority Data

Dec. 10, 1982 [SE] Sweden ..... 8207098

[51] Int. Cl.[4] ..... D03D 47/36

[52] U.S. Cl. ..... 139/435; 242/47.01; 139/452

[58] Field of Search ..... 139/435; 242/47.01, 242/47.12, 47.13

[56] References Cited

U.S. PATENT DOCUMENTS

| | | | |
|---|---|---|---|
| 3,776,480 | 12/1973 | Lawson | 242/47.1 |
| 3,853,153 | 12/1974 | VanDuynhoven et al. | 139/435 |
| 4,020,877 | 5/1977 | Spisiak | 139/435 |
| 4,445,546 | 5/1984 | Hintsch | 139/435 |
| 4,458,726 | 7/1984 | Wenig | 139/435 |

FOREIGN PATENT DOCUMENTS

| | | |
|---|---|---|
| EP83/94099 | 11/1983 | European Pat. Off. . |
| 2908743 | 9/1979 | Fed. Rep. of Germany . |
| 2836206 | 2/1980 | Fed. Rep. of Germany . |
| 3123760 | 2/1982 | Fed. Rep. of Germany . |
| 1562223 | 4/1969 | France . |
| WO84/01394 | 4/1984 | PCT Int'l Appl. . |
| 2027945 | 2/1980 | United Kingdom . |

*Primary Examiner*—Henry S. Jaudon

*Attorney, Agent, or Firm*—Flynn, Thiel, Boutell & Tanis

[57] ABSTRACT

Method of controlling a plurality of relay nozzles (RNx) is a jet weaving machine. These nozzles are consecutively actuated for supporting the insertion of the weft yarn (WY) into the shed of the weaving machine and up to the arrival end (AE) of said shed by means of consecutively opening solenoid valve associated with nozzles. The valves are controlled on the basis of calculated information representing the momentary real position of the weft yarn (WY) during it path in the shed. The invention also relates to an apparatus for carrying out said method.

13 Claims, 7 Drawing Figures

CCU
TO MN AND RNX

METHOD AND DEVICE FOR CONTROLLING A PLURALITY OF RELAY NOZZLES IN A JET WEAVING MACHINE

FIELD OF THE INVENTION

The present invention relates to a method and apparatus for controlling a plurality of relay nozzles in a jet weaving machine.

BACKGROUND OF THE INVENTION

The present invention relates to a method and device for controlling a plurality of relay nozzles in a jet weaving machine. Such relay nozzles are sequentially actuated, i.e. opened, for supporting the insertion of the weft yarn into the shed of the weaving machine, from the insertion side of the machine and up to the arrival end of the shed on the other side of the machine. The actuation of the relay nozlzes is carried out by sequentially opening electro-magnetic or solenoid valves associated with the nozzles. In some known types of weaving machines the relay nozzles are kept open from the moment when they are opened up to the moment when the weft yarn reaches the arrival end of the shed, at which latter moment all relay nozzles are closed simultaneously. In other types of machines the relay nozzles are sequentially closed a predetermined moment of time after they have been opened. The present invention is applicable to both these different kinds of relay nozzle control.

A known method of the above-mentioned kind is for example disclosed in German Offenlegungsschrift No. 28 36 206. There, the relay nozzles are actuated in synchronism with the rotation of the main shaft of the weaving machine. For carrying out this known method, the electro-magnetic or solenoid valves associated with the relay nozzles are connected to and thus receive actuation signals from a rotary sensor in the form of a code disc co-acting with an optical detector, said code disc being fixed on the main shaft.

This known method works in an optimal way only if there is a perfect synchronism between the weft insertion process and the rotation of the main shaft of the weaving machine. However, such a synchronism cannot always be maintained, since on one hand the main shaft rotation is a relatively non-varying parameter in this connection, whereas on the other hand the weft yarn insertion curve as a function of time can vary a great deal in dependence on e.g. the pressure of the utilized compressed medium, preferably air, and also from yarn to yarn having different friction coefficient, thickness and structure. This means with the known method that the control of the nozzles must be carried out with sufficient compensation for the variations in synchronism between the weft insertion process and the main shaft rotation, preferably by providing relatively generous time tolerances for the sequential opening (and closing, if any) of the series of nozzles. As a consequence hereof the nozzles will consume much more pressure medium (air) than would be necessary for the support of weft insertion as such, which altogether means higher production costs for the woven fabric.

The object of the present invention is primarily to provide a method and a device by which the above-mentioned drawbacks have been eliminated.

SUMMARY OF THE INVENTION

This is achieved in accordance with the invention by the solenoid valves for the relay nozzles being controlled on the basis of calculated information representing the momentary actual position of the leading end of the weft yarn during its path in the shed of the weaving machine.

By this method the necessary opening time intervals can always, irrespective of varying compressed medium pressure, wearing of the nozzles and valves, and utilized yarn quality, be kept at a minimum, which means considerable savings in compressed medium consumption and corresponding reduction of production costs.

An apparatus for carrying out this new method is based on Applicant's own earlier international patent application No. PCT/EP 83/00254 and has a yarn storing, feeding and measuring device for the weft yarn to be supplied into the shed of the weaving machine, said device comprising a stationary storing drum onto which an intermediate yarn store is wound by a winding-on member and from which the yarn is withdrawn spiralling around the withdrawal end of the storing drum. Said device also comprises yarn sensing means being arranged such that the yarn is passing its detection area during withdrawal from the drum, said yarn sensing means producing pulse signals, each pulse indicating that the yarn passes its detection area, a plurality of yarn stopping devices being arranged at angular intervals around the storing drum, said yarn stopping devices consisting of yarn stopping elements and of actuator means for moving said stopping elements into and out of the path of the yarn being withdrawn, and an actuator control device adjustable to desired yarn lengths to be withdrawn and comprising storing means for storing information regarding the yarn stopping device actuated at the end of a previous yarn withdrawal cycle. In accordance with the present invention the actuator control device comprises calculating means for determining the momentary position of the withdrawal point of the yarn, based on said stored information and of the period of time between two subsequent pulse signals from the yarn sensing means, which calculating means is electrically connected to the solenoid valves of the relay nozzles, and the calculating means transmits on actuation signal to each respective one of said nozzles for opening said nozzle at the moment when the calculated momentary position of the withdrawal point of the yarn on the storing drum corresponds to a yarn length being withdrawn which equals the distance of said nozzle from the yarn insertion end of the shed of the weaving machine.

In the preferred embodiment of the present invention the calculating means is also arranged to transmit a de-actuation signal to each respective nozzle for closing same a predetermined moment of time after its opening, preferably at the moment when the calculating means transmits an actuation signal to the subsequent nozzle in the series along the shed of the weaving machine.

BRIEF DESCRIPTION OF THE DRAWINGS

A preferred embodiment of the present invention will now be described with reference to the enclosed drawings, where FIG. 1 schematically shows an embodiment of the weft insertion means of a jet weaving machine, known per se, in which the method in accordance with the present invention can be carried out, and in which a device according to the invention is comprised as one of the components.

DETAILED DESCRIPTION

Figure 1:
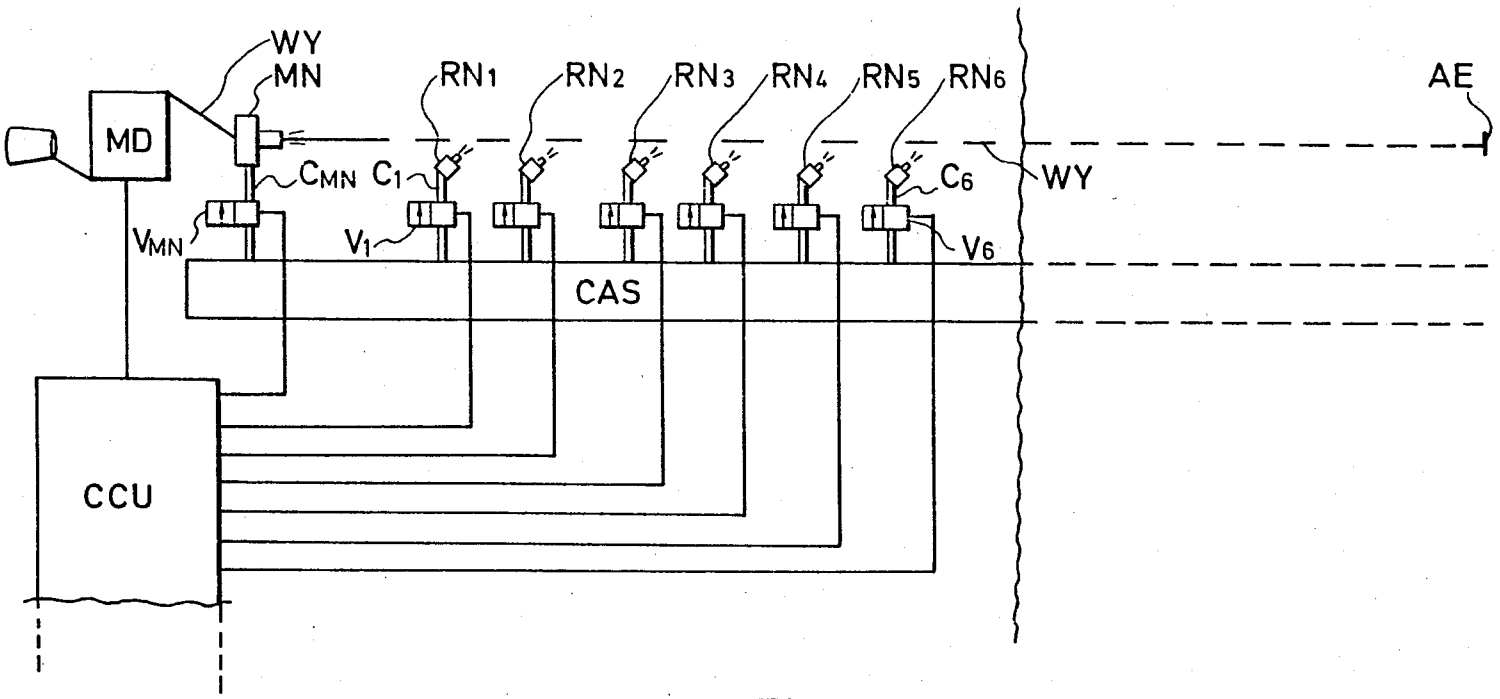

In FIG. 1, the weft insertion means for the weft yarn WY in a jet weaving machine, of conventional kind per se, here a so called air jet loom, comprises a main air jet nozzle MN and a number of so called air jet relay nozzles, by way of example let us say sixteen nozzles, of which here only six are shown RN1-RN6. All nozzles are supplied with compressed air via conduits CMN and C1-C6 from a compressed air source CAS, preferably a conventional air compressor. The supply of compressed air to the nozzles is controlled by means of solenoid valves VMN, V1-V6, which in turn are electrically connected to and controlled by means of a central control electronic unit CCU, which will be described in detail in the following with reference to FIGS. 6 and 7.

The weft yarn WY comes from a yarn spool YS and is wound onto a yarn storing, feeding and measuring device MD in accordance with the invention, which will be described closely in the following with reference to FIGS. 2-5. This yarn storing, feeding and measuring device is also connected to and controlled by the central control electronic unit CCU.

The weft yarn WY is withdrawn from the yarn storing, feeding and measuring device MD and is inserted into the weaving shed WS of the weaving machine by the main air jet nozzle MN being actuated when valve VMN is opened due to an actuation signal from the central control unit CCU. The further insertion of the weft yarn WY into the shed and over to the so called arrival end AE thereof is supported by sequentially, in a consecutive manner, actuating the sixteen relay nozzles RN1-RN16, the actuation of each respective nozzle being controlled from the central control unit CCU by the method according to this invention, which will be described in detail further below.

Figures 2, 3, 4, 5:
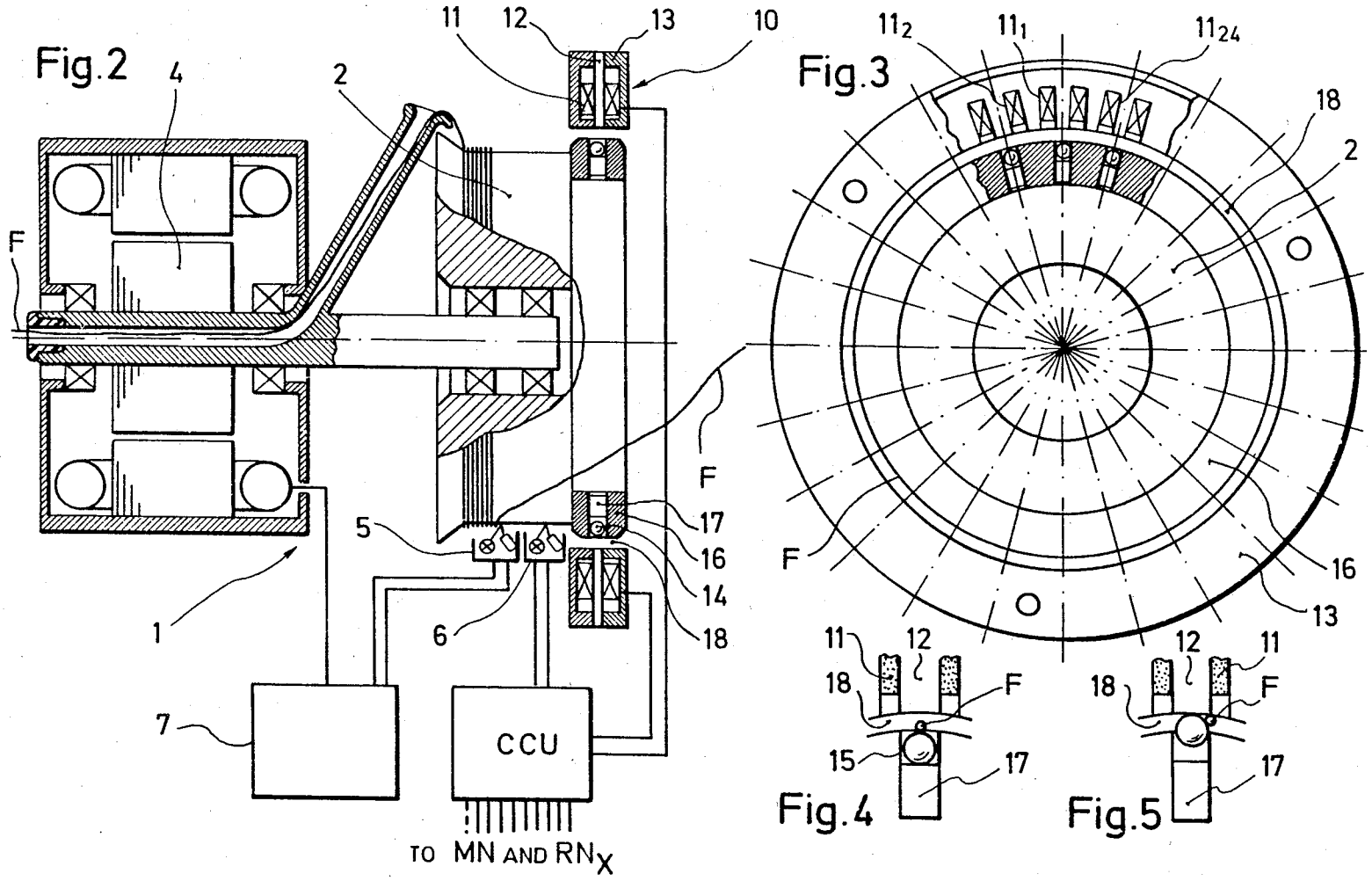
FIG. 2 shows a side view of a device by which the method in accordance with the invention can be carried out, partially in cut- and cross-sectional representation.
FIG. 3 shows a front view of the device as shown in FIG. 2.
FIG. 4 shows, as well as FIG. 5, details of the device shown in FIGS. 2 and 3.

Referring now to FIG. 2, a feeding device 1 consists of a storage drum 2, a winding-on device which is an orbiting feeder tube 3 and an electric motor 4. A weft yarn WY being supplied to the orbiting feeder tube 3 driven by the electric motor 4 is wound onto the storage drum 2. This storage drum is a stationary storage drum being maintained in a stationary position with respect to its environment by a magnetic means (not shown here, but well-known in the art). Devices of this type are for example shown in U.S. Pat. Nos. 3 776 480 and 3,853,153. The feeding device 1 is provided with a yarn store sensor 5 located close to the generally cylindrical surface of the storage drum 2. This store sensor 5 can be a so called maximum sensor preferably consisting of a light emitting device and a light sensing device. The yarn store sensor 5 generates a signal indicating the amount of yarn stored on the drum, i.e. in principle the number of turns of yarn wound onto the drum. Based on this signal, a store control unit 7 controls the operation of the electric motor 4 in such a way that there is continuously a sufficient amount of yarn available on the yarn storage drum 2. Yarn store control units are per se known in the art. For purposes of the present disclosure, it should be noted that this art is exemplified by German Offenlegungsschrift No. 29 08 743, French Publication No. 1 562 223 and International application Ser. No. PCT/EP 83/00121 (applicant's own) which corresponds to U.S. Ser. No. 588,866 filed Jan. 10, 1984.

As shown in FIG. 2, there is disposed a yarn sensing means 6 at the withdrawal end of the storage drum arranged such that the yarn is passing its detection area during withdrawal from the drum 2. This yarn sensing means preferably consists of a single yarn sensor 6 producing pulse signals, each pulse signal indicating that the yarn WY passes the detection area of the sensor 6. This sensor 6 could also be located in front of the withdrawal end of the storage drum, but has to be arranged such that the yarn is passing its detection area during withdrawal from the storage drum 2. A yarn stopping device 10 located at the withdrawal end of the storage drum 2 consists of an actuator means comprising a plurality of electromagnetic coils 11 being wound around a coil core 12 supoorted by a balloon limiting ring 13 consisting of two U-shaped rings covering said plurality of electromagnetic coils 11. Said balloon limiting ring 13 is fixedly secured to the stationary part of the feeding device 1, for example to a base plate thereof. A ring-shaped guiding portion 16 is connected to the withdrawal end of the storage drum 2. Said guiding portion 16 supports a plurality of yarn stopping elements, each of said yarn stopping elements consisting of a metal ball 14 being movably disposed in a radial bore 15 provided in the guiding portion 16.

As shown in FIGS. 4 and 5, the respective electromagnetic coils 11 and associated cores 12 are arranged opposite to said bores 15. The balloon limiting ring 13 and the guiding portion 16 define a gap 18 which is preferably in the order of 1-2 millimeters. The yarn WY passes said gap when being withdrawn from the storage drum 2. A permanent magnet 17 is located at one end of each bore 15 for moving back said metal ball 14 into said bore 15 after switching off an actuation current fed to the respective electromagnetic coils 11. As shown in FIGS. 4 and 5, the metal ball 14 is attracted by the magnetic force of the coil 11 when switching on the actuation current fed to the coil 11. The width of the gap 18 corresponds to the radius of the metal ball 14. When the coil 11 is not actuated, the permanent magnet 17 will attract the metal ball 14, so that the ball will be completely positioned inside the bore 15, whereby the yarn WY can be freely withdrawn in the axial direction from the storage drum 2.

The magnetic force of each electromagnetic coil 11 is chosen such that this force will overcome the attraction force of the permanent magnet 17 when feeding the actuation current to the coil 11. The metal ball 14 will thereby move outwardly in the radial direction of the bore 15 and come into contact with the free end of the coil core 12. In this condition, approximately half the metal ball locks the gap 18 for the passage of the yarn WY in such a way that the withdrawal of the yarn from the storage drum 2 is terminated. When switching off the actuation current fed to the coil 11, the tension in the yarn WY, being pulled at the beginning of the weft yard insertion into the weaving machine, co-acts with the magnetic force of the permanent magnet 17 such that the metal ball 14 will return to its starting position so as to come into contact with the permanent magnet 17. As the tension of the yarn co-acts with the magnetic force of the permanent magnet 17 due to the shape of the metal ball 14, the holding force of the permanent magnet 17 can be relatively low. Hence, only a small portion of the attracting force generated by the electromagnetic coil 11 is required for overcoming the magnetic force of the permanent magnet 17. For this reason, the yarn stopping device 10 works faster than prior art devices using stopping elements which are needle-shaped or pin-shaped. For further enhancing the operation of the yarn stopping device 10, a thin plate of non-magnetic material can be positioned at the outer end of the permanent magnet 17 and/or on the free end of the coil core 12 for eliminating a magnetic sticking or "adhesion" between the metal ball 14 and permanent magnet 17 and/or the coil core 12.

The stopping element 14 can also have the form of a shortcylindrical pin with a plane inner end directed to the permanent magnet 17 and a rounded, preferably semi-spherical end.

Figure 6:
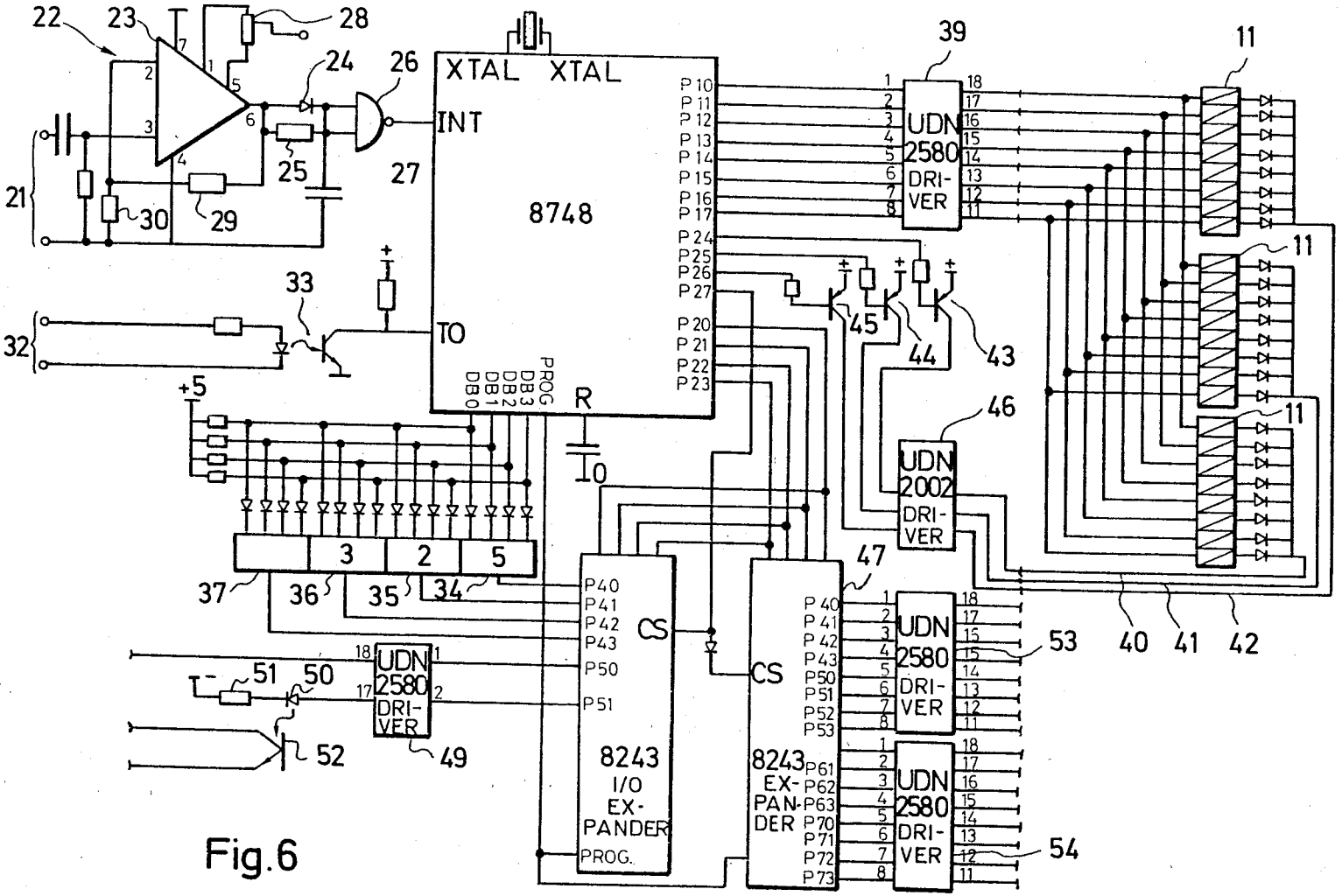
FIG. 6 shows a circuit diagram of a control unit comprised in the device shown in FIGS. 2-5.

Referring now to FIG. 6, the control device CCU will be hereinafter described in detail. The control device comprises a calculating means 20, which is a standard microprocessor. The microprocessor 20 is preferably a microprocessor of the type 8748, manufactured by the INTEL Corp., U.S.A. The yarn sensor 6 is connected to an input 21 of a yarn sensor interface circuit 22. The yarn sensor interface circuit 22 essentially consists of an operational amplifier 23 connected, through a diode 24 and a resistor 25 connected in parallel to diode 24, to an inverter gate 26, the output thereof being connected to input pin INT of the microprocessor 20. The input terminals of the inverter gate 26 are connected to ground via a capacitor 27. The gain of the operational amplifier 23 can be adjusted by a variable gain control resistor 28 connected to the operational amplifier 23. When a pulse is generated by the yarn sensor 6, it will be current-amplified by the operational amplifier 23. The output current of the operational amplifier 23 passes the diode 24 and charges the capacitor 27. When the pulse signal goes back to zero potential, the capacitor 27 is discharged through resistors 25, 29 and 30 to ground. Due to the switching threshold of the inverter gate 26, only pulses of a predetermined voltage are detected, so that the yarn sensor interface circuit 22 disregards small noise voltages. As the capacitor can be quickly charged through diode 24 and is only slowly discharged through resistors 25, 29 and 30, short input pulses are transformed to longer output pulses as generated by gate 26. Such a broadening of the very short input pulses enables the microprocessor 20 to reliably detect the input pulses, i.e. the extremely quick passages of the yarn in the detection area of the sensor 6.

The microprocessor 20 is supplied with sync signals generated by a crystal resonator 31 connected to input pins XTAL of the microprocessor.

A trigg-input 32 receives a signal picked up at the main shaft of the weaving machine. This signal is applied to the input of an opto-electronical coupling element 33, the output of which is connected to pin TO of the micro-processor. The trigg-signal serves to synchronize the operation of the loom with the operation of the microprocessor 20 controlling the yarn storing, feeding and measuring device 1. More particularly, the occurrence of the trigg-signal indicates that the next weft yarn insertion cycle is about to start.

In the central control unit CCU there is provided a combined number of nozzles/yarn length setting switching device, preferably consisting of three BCD-switches 34–36 and a Hexadecimal code switch 27, each of these switches having four input terminals and one output terminal. Each of the BCD-switches can be set to a decimal number from 0–9 and the Hexadecimal code switch from 0–F (=16). This decimal or hexadecimal number is converted by the respective switch such that the corresponding one of its four input terminals is connected to its output terminal in accordance with the code. When for example setting one of the BCD-switches to the decimal number 5, then its first and third input terminals are connected to its output terminal, whereas its second and fourth input terminals are disconnected from the output terminal. The respective first input terminals of the switches 34–37 are connected via diodes to input pin D83 of the microprocessor 20, the respective second input terminals of the switches are connected via diodes to input pin D82 of the microprocessor, the respective third input terminals of the switches are connected via diodes to input DB1 of the microprocessor and the respective fourth input terminals of the switches are connected via diodes to input DB0 of the microprocessor 20. The respective output terminals of the switches 34–37 are connected to output pins P40–P43 of an expansion circuit 38, here a standard circuit INTEL 8243, the four input pins of which are connected to output pins P20–P23 of the microprocessor 20. At the beginning, each of the input pins DB0–DB3 of the microprocessor 20 is in its "high" state, i.e. logical one potential. The input pins P20–P23 of the microprocessor are also in the "high" state. For reading the value of one of the switches 34–37, the microprocessor 20 pulls down the voltage of one of its input pins P20–P23. For example, for reading the BCD value of BCD switch 34, the microprocessor will generate a predetermined combination of "high" and "low" potential pins on its pins P20–P23 and PROG, whereby pin P40 of circuit 38 will receive "low" potential. In case the decimal number selected by switch 34 is "5" the voltage of input pins DB3 and DB1 of the microprocessor 20 will be pulled down to zero potential, i.e. to the "low" logical state, whereas the logical state of input pins DB2 and DB0 remain "high".

Output pins P10–P17 of the microprocessor 20 are connected to input pins 1–8 of an amplifier circuit 39, this amplifier circuit or driver circuit 39 having eight output terminal pins 11–18, each of these being associated with a respective input pin 1–8. When receiving an input signal of "high" potential (logical one) at its input pins 1–8, the amplifier circuit 39 connects the corresponding output terminal pin to a voltage source having a potential of −35 Volts. Each of the output pins 11–18 of the amplifier circuit 39 is connected to three electromagnetic coils 11. Twenty-four electromagnetic coils 11 associated with twenty-four yarn stopping devices 10 are arranged as a matrix having eight rows and three columns. The respective output terminals of the electromagnetic coils 11 arranged in one column are connected to a respective one of three output conductors 40–42.

Output pins P24–P26 of the microprocessor 20 are connected through current amplifier circuits 43–45 to input pins 1–3 of a further driver circuit 46. This driver circuit 46 includes three three output pins 14–16, each being connected to a respective one of the conductors 40–42. When receiving a "high" potential (logical one) at one of its input pins, the driver circuit 46 connects the corresponding output pin to a voltage of +5 Volts. Due to the above described circuit matrix arrangement, the microprocessor 20 is enabled to energize one of the twenty-four electromagnetic coils 11 by generating a high potential at one of the output pins P10–P17 determining the row of the coil 11 to be actuated, and by generating a high potential at one of its output pins P24–P26 selecting the column of the electromagnetic coil 11 to be actuated. The above described matrix arrangement allows actuation of one electromagnetic coil 11 among the twenty-four electromagnetic coils 11 with only eleven output pins P10–P17 and P24–P26.

Output pin P27 of the microprocessor 20 is connected to the input pin CS of the first expansion circuit 38 as well as to a corresponding input pin CS of a second expansion circuit 47, this also being a standard circuit INTEL type 8243, through over an inverter 48. Output pin P51 of the first expansion circuit 38 is connected via a current amplifier 49 to a light-emitting element 50, which in turn is connected to ground via a resistor 51. The light-emitting element 50 actuates an opto-sensitive switching element 52 actuating a stop-motion-relay (not shown here) of the weaving machine.

Output pin P50 of the first expansion circuit 38 is connected through the driver circuit or current amplifier 49 to a relay of the valve VMN of the main air jet nozzle MN of the loom (shown in FIG. 1).

The amplifier circuits 39 and 49 are standard circuit elements of the type UDN 2580A. The amplifier or driver circuit 46 is also a standard circuit element of the type UDN 2002. The manufacturer of all the mentioned driver or amplifier circuits is the SPRAGUE Corp. U.S.A.

Output pins P40–P43, P50–P53, P60–P63 and P70–P73 of the second expansion circuit 47 are each connected via one of two amplifier or driver circuits 53 or 54, in the form of standard circuit elements type UDN 2580A, to a respective relay in the solenoid valve of one of the sixteen relay nozzles RN1–RN16 along the path of the weft yarn in the shed of the weaving machine.

The two expansion circuits 38 and 47 receive instruction signals to their input pins PROG from the PROG output of the microprocessor 20.

Figure 7:
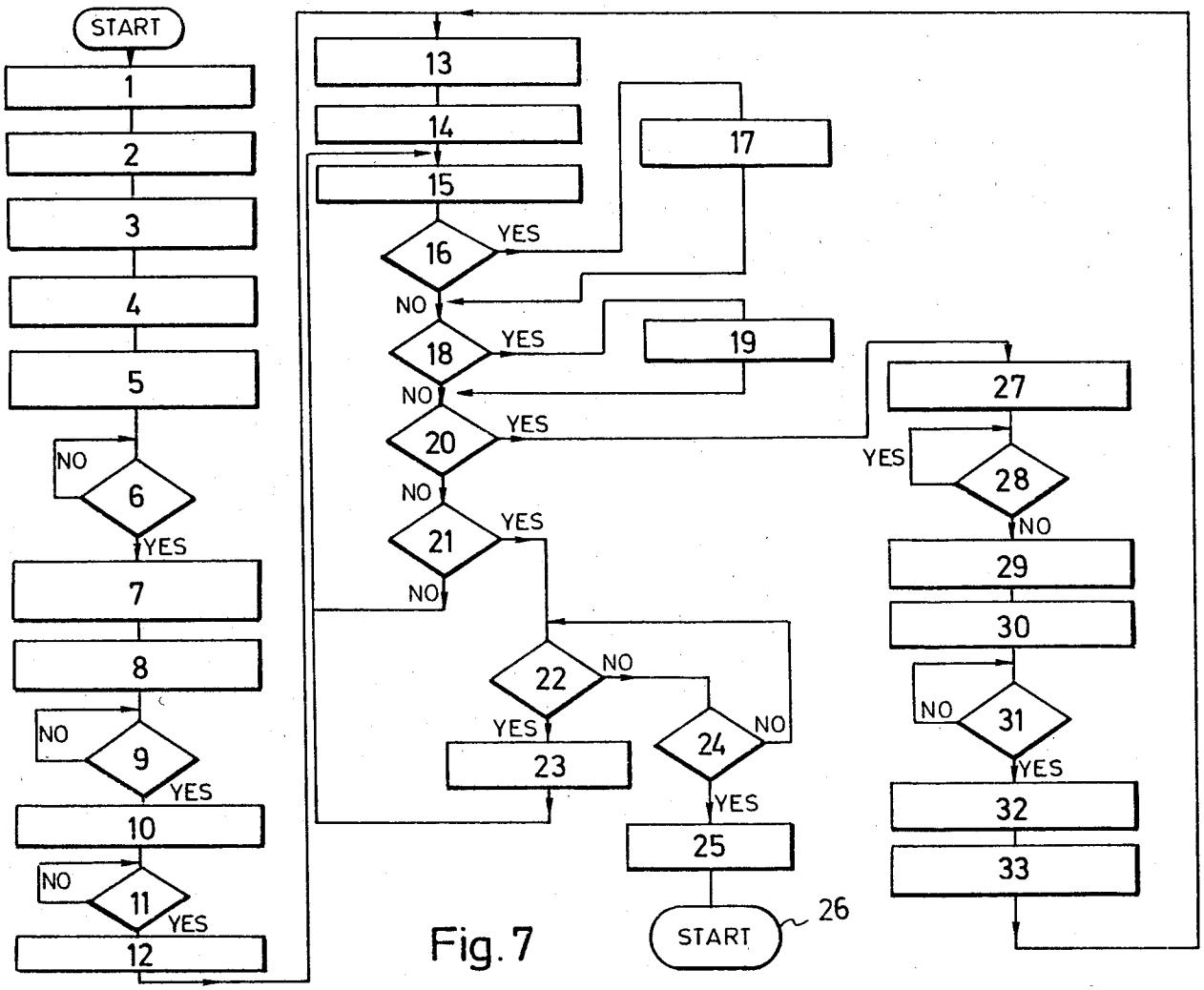
FIG. 7 shows a flow diagram used in a microprocessor of the control unit as shown in FIG. 6.

Referring now to FIG. 7, there is shown a flow diagram of the control programme stored in the read-only memory of the microprocessor 20. When receiving a reset signal, the microprocessor 20 is reset so as to start the carrying out of the programme with the first instruction thereof, being the "START" instruction.

At programme step No. 1, the microprocessor 20 actuates a predetermined yarn stopping device 10 for locking the yarn WY in its start position. Preferably, said stopping device 10 is selected such that its angular position is 180° off-set with respect to the angular position of the yarn sensor 6. The microprocessor 20 stores the number or the angular position of said stopping device in a predetermined storage cell of its RAM.

At programme step No. 2, the microprocessor 20 consecutively reads the BCD code of the switches representing the desired weft yarn length and stores the corresponding BCD codes in predetermined storage cells of its RAM.

At programme step No. 3, the microprocessor 20 converts the BCD codes representing the desired weft yarn length to a digital value corresponding to the number of full revolutions and 1/24 revolutions of the storage drum, whereby this digital value represents the number of revolutions which the withdrawal point of the yarn travels during withdrawal of the desired weft yarn length. It is also possible to express said desired weft yarn length by a value corresponding to the time required for withdrawing said desired weft yarn length.

At programme step No. 4, the microprocessor 20 reads the hexa-decimal code of the switch 37 representing the actual number of relay nozzles of the weaving machine in question, i.e. in this case F=16.

At programme step No. 5, the microprocessor 20 calculates the distance between the relay nozzles on the basis of the set weft yarn length, since in this embodiment the relay nozzles are positioned with equal interspacings along the whole shed of the weaving machine.

At programme step No. 6, there is a waiting routine, causing the microprocessor 20 to await the receipt of a trigg-signal from the weaving machine before going further to programme step No. 7. This waiting routine is realized by a programme loop periodically checking whether the trigg-signal occurs. If said condition is fulfilled, the microprocessor continues with the programme step No. 7.

At programme step No. 7, the microprocessor generates a "high" potential at its output pin P50 for actuating the relay controlling the valve of the main air jet nozzle in the weaving machine.

At programme step No. 8, tne stopping device 10 actuated during programme step No. 1 is deactuated for releasing the yarn WY.

At programme step No. 9, the microprocessor 20 checks whether the yarn passes the yarn sensor 6 by repeatedly checking the logical state on its input pins P1 and P6. If this condition is fulfilled, the microprocessor 20 continues with proramme step No. 10.

At programme step No. 10, the microprocessor 20 starts to measure the time lapsing from the moment of generation of the pulse signal indicating the passage of the yarn through the detection area of the yarn sensor 6.

At programme step No. 11, the microprocessor 20 again carries out a waiting loop corresponding to the waiting loop of programme step No. 6. As soon as the yarn has passed the yarn sensor 6, microprocessor 20 continues with the programme step No. 12.

At programme step No. 12, the microprocessor 20 stores the time between two subsequent pulse signals as received from the yarn sensor 6. The microprocessor 20 then starts again to measure the time.

At programme step No. 13, the microprocessor 20 calculates at which yarn withdrawal position the main air jet nozzle is to be switched off.

At programme step No. 14, the microprocessor 20 calculates at which yarn withdrawal position the stopping device 10 determined during programme step No. 3 is to be actuated.

At programme step No. 15, the microprocessor 20 calculates the momentary position of the yarn withdrawal point on the storage drum based on the actual yarn withdrawal speed being measured during programme step No. 12.

At programme step No. 16, the microprocessor 20 checks whether the calculated, momentary position of the yarn withdrawal point as determined during programme step No. 15 corresponds to the position of the next relay nozzle RN in the shed, which means that the leading end of the weft yarn WY has reached the position of the next relay nozzle during its insertion in the shed of the weaving machine. If this condition is fulfilled, the microprocessor 20 continues with programme step No. 17. If not, it continues with programme step No. 18. Of course, this means that when this programme step No. 16 is carried out for the first time after start of the yarn withdrawal the microprocessor 20 checks if the calculated, momentary position of the yarn withdrawal point corresponds to the position of the *first* relay nozzle RN1, whereas when this programme step No. 16 is carried out for the second time after a yarn withdrawal start, the microprocessor 20 will compare the calculated, momentary position of the yarn withdrawal point with the position of the *second* relay nozzle RN2, and so on.

In this embodiment of the invention, at programme step No. 17, the microprocesor 20 will open the "next" relay nozzle RN in the series *and* close the next preceding relay nozzle by appropriately generating a "high" potential or a "low" potential on the respective output pins 11–18 belonging to the nozzles in question of the driver circuits 53, 54.

In another possible embodiment of the invention, at programme step No. 17, the microprocessor 20 will *only* open the "next" relay nozzle in the series, whereas the closing of *all* relay nozzles is arranged to take place simultaneously with the closing of the main jet nozzle, i.e. at the end of the weft insertion process.

At programme step No. 18, the microprocessor 20 checks whether the calculated, momentary position of the yarn withdrawal point as determined during programme step No. 15 equal to the position determined during programme step No. 13. If this condition is fulfilled, the microprocessor 20 continues with programme step No. 19. If not, it continues with programme step No. 20.

At programme step No. 19, the microprocessor 20 switches off the main jet nozzle MN by pulling down the output pin P50 of the first expansion circuit 38.

At programme step No. 20, the microprocessor 20 checks whether the calculated, momentary position of the yarn withdrawal point as determined during programme step No. 15 corresponds to the yarn position as calculated during programme step No. 14. If so, the microprocessor goes to programme step No. 27. If not, it continues with carrying out programme step No. 21.

At programme step No. 21, the microprocessor 20 checks if the calculated position as determined during programme step No. 15 is close to the position of the yarn sensor 6. By doing so, a time-window is realized. In case this condition is not fulfilled, the microprocessor 20 goes back to programme step No. 15. If it is fulfilled, it continues with programme step No. 22.

At programme step No. 22, the microprocessor 20 again checks if the yarn has passed the yarn sensor 6. This programme step corresponds to programme step No. 9. If this condition is fulfilled, the microprocessor 20 continues with programme step No. 23. If not, it continues with programme step No. 24.

At programme step No. 23, the microprocessor 20 stores the measured time between two subsequent pulse signals as received from the yarn sensor 6 and goes back to programme step No. 15.

At programme step No. 24, there is a safety-routine for checking if a yarn breakage has occurred. This safety-routine is realized by comparing the calculated time with a time threshold which is only exceeded in case of a yarn breakage. In other words, the microprocessor 20 checks whether the measured time lapsed since the last passage of the yarn through the detection area of the yarn sensor 6 exceeds a time threshold. If this condition is not fulfilled, the microprocessor continues with programme step No. 22, whereas if it is not fulfilled, it goes to programme step No. 25.

At programme step No. 25, the weaving machine is stopped since a yarn breakage has occurred. For this purpose, the microprocessor 20 generates a "high" potential on the output pin P51 of the first expansion circuit 38.

At programme step No. 26, the microprocessor 20 goes back to the start-instruction of the programme when having received a reset-signal.

At programme step No. 27, the microprocessor 20 actuates the stopping device as determined or selected during programme step No. 3 for stopping the yarn withdrawal from the storage drum 2. Furthermore, the microprocessor 20 stores the number of the now actuated stopping device in a pedetermined storage cell of its RAM.

At programme step No. 28, the microprocessor 20 checks whether the trigg-signal as received at programme step No. 6 has disappeared in the meantime. As soon as the trigg-signal has disappeared, the microprocessor 20 goes to programme step No. 29.

At programme step No. 29, the microprocessor 20 carries out a programme step corresponding to programme step No. 2.

At programme step No. 30, the microprocessor 20 carries out a programme step corresponding to programme step No. 3.

At programme step No. 31 there is a waiting routine for repeatedly checking whether a trigg-signal is fed to the trigg-input 32. Such a trigg-signal indicates that the weaving machine is ready for the insertion of a weft yarn again. As soon as the trigg-signal is generated, the microprocessor 20 goes to programme step No. 32.

At programme step No. 32, the microprocessor 20 switches on the main air jet nozzle of the weaving machine by generating a "high" potential signal at output pin P50 of the first expansion circuit 38.

At programme step No. 33, the microprocessor 20 de-actuates the stopping device actuated when carrying out the programme step No. 27. The microprocessor then goes back to programme step No. 13.

The present invention is not limited to the embodiment described in the above and shown in the drawings, but several other embodiments are possible within the scope of the invention.

The embodiments of the invention in which an exclusive property or privilege is claimed are defined as follows:

1. An apparatus for controlling a plurality of relay nozzles in a jet weaving machine, comprising control means for consecutively actuating said nozzles for supporting the insertion of a weft yarn into the shed of the weaving machine and up to the arrival end of said shed by consecutively opening solenoid valves associated with said nozzles, said valves being controlled on the basis of calculated information representing the momentary real position of the weft yarn during its movement through the shed, said weaving machine including a yarn storing, feeding and measuring device for the weft yarn to be supplied, said device including a stationary storage drum onto which an intermediate yarn store is wound by a winding-on member and from which the yarn is withdrawn spiralling around a withdrawal end of the storage drum, yarn sensing means arranged such that the weft yarn periodically passes its detection area during withdrawal from the drum, said yarn sensing means producing pulse signals, each said pulse signal indicating that the yarn is passing its detection area, and at least one yarn stopping device located at the withdrawal end of the storage drum and including a yarn stopping element and actuator means for moving said stopping element into and out of the path of the yarn being withdrawn, said control means including an actuator control device which has storing means for storing information regarding the yarn stopping device actuated at the end of the next preceding yarn withdrawal cycle and has calculating means for determining the momentary position of the withdrawal point of the yarn based on said stored information and on the periods of time between successive pulse signals from the yarn sensing means, said calculating means being electrically connected to said solenoid valves of the relay nozzles, and said calculating means transmitting a respective actuation signal to each of said nozzles for opening said nozzle at the moment when the calculated momentary position of the withdrawal point of the yarn on the storage drum corresponds to a length of the weft yarn being withdrawn which is equal to the distance of said nozzle from the insertion end of the shed of the weaving machine.

2. Apparatus as claimed in claim 1, wherein said calculating means includes position determining means for determining the momentary position of the withdrawal point of the weft yarn, said position determining means including means for:

(a) setting the calculated momentary position to a value corresponding to the position of the previously actuated yarn stopping device, (b) incrementing the calculated momentary position at a predetermined rate and checking whether the calculated momentary position equals the position of the yarn sensing means, and (c) when the calculated position is equal to the position of the yarn sensing means, holding the calculated momentary position while awaiting a pulse signal from the yarn sensing means and going back to step (b) as soon as the yarn sensing means generates said pulse signal, the generation of said pulse signal indicating that the calculated momentary position is equal to the real position of the withdrawal point of the yarn.

3. Apparatus as claimed in claim 1, wherein the yarn sensing means has only one single yarn sensor.

4. Apparatus as claimed in claim 1, wherein said calculating means includes a microprocessor.

5. Method for controlling a jet weaving machine which includes a yarn storing device from which a weft yarn can be withdrawn and a plurality of selectively actuable relay nozzles provided at spaced locations along a shed of the weaving machine to carry a weft yarn withdrawn from said storing device through the shed, comprising the steps of: monitoring the speed at which a weft yarn is withdrawn from said storing device; periodically calculating the momentary position of the weft yarn being inserted through the shed as a function of the actual speed of withdrawal of the weft yarn from the storing device; and successively actuating said relay nozzles during the insertion of the weft yarn through the shed by generating a respective actuation signal for each said relay nozzle when said calculated momentary position reaches a respective predetermined value associated with such relay nozzle.

6. Method for controlling a plurality of relay nozzles in a jet weaving machine having a yarn storing, feeding and measuring device, stopping means for preventing withdrawal of a yarn from said yarn storing, feeding and measuring device, and yarn sensor means located close to the path of the yarn for detecting the withdrawal of the yarn from a storage drum of said yarn storing, feeding and measuring device, said relay nozzles being consecutively actuated for guiding and supporting the weft yarn through a shed of the fabric after deactuating said stopping means, comprising the steps of:

continuously measuring the period of time elapsed following a deactuation of said stopping means for initiating a weft yarn insertion;

periodically calculating an actual withdrawal length of said yarn on the basis of said measured period of time, and correcting said calculated withdrawal length on the basis of a signal generated by said yarn sensor means; and successively actuating the respective relay nozzles on the basis of said corrected calculated withdrawal lengths.

7. Method as claimed in claim 6, wherein the step of correcting said calculated withdrawal length includes the step of measuring the period of time between consecutive pulse signals generated by said yarn sensor.

8. Apparatus for controlling a jet weaving machine which includes a yarn storing device from which a weft yarn can be withdrawn and a plurality of selectively actuable relay nozzles provided at spaced locations along a shed of the weaving machine to carry through the shed a weft yarn withdrawn from the storing device, comprising sensor means in the region of said storing device for monitoring the speed at which a weft yarn is withdrawn from said storing device, and calculating means responsive to said sensor means for peridically calculating the momentary position of the weft yarn being inserted through the shed as a function of the actual speed of withdrawal of the weft yarn from the storing device and for successively actuating said relay nozzles by generating a respective actuation signal for each said relay nozzle when said calculated momentary position reaches a respective predetermined value associated with such relay nozzle.

9. Apparatus for controlling relay nozzles in a jet weaving machine, comprising: a yarn storing, feeding and measuring device for the weft yarn to be supplied, said yarn storing, feeding and measuring device including a storage drum; yarn sensing means arranged so that the weft yarn periodically passes its detection region during withdrawal from the drum, said sensing means producing a pulse each time the yarn passes its detection region; at least one yarn stopping device which is located at the withdrawal end of the storage drum and which, when actuated, prevents withdrawal of the yarn from said drum; and calculating means for periodically calculating the momentary withdrawal length of the yarn on the basis of the periods of time between consecutive pulse signals from said yarn sensing means, wherein said calculating means is electrically connected to said relay nozzles and transmits a respective actuation signal to each said nozzle as soon as the momentary withdrawal length of the yarn is equal to the distance of such nozzle from an insertion end of the shed of the weaving machine.

10. Apparatus as claimed in claim 9, including at least two of said yarn stopping devices, wherein said calculating means further includes storing means for storing information identifying the yarn stopping device actuated at the end of an immediately preceding yarn withdrawal cycle, and wherein said calculating means calculates the momentary withdrawal length of the yarn on the basis of said stored information and on the basis of the periods of time between consecutive pulse signals received from said yarn sensing means.

11. Apparatus as claimed in claim 10, wherein said calculating means includes means for:

(a) setting a calculated momentary position to a value corresponding to the position of the previously actuated yarn stopping device;

(b) incrementing the calculated momentary position at a predetermined rate and checking whether the calculated momentary position is equal to the position of said yarn sensor means; and (c) when the calculated momentary position equals the position of the yarn sensor means, holding the calculated momentary position while awaiting a pulse generated by said yarn sensor means and going back to step (b) as soon as said yarn sensor means generates a pulse, wherein the generation of a pulse by said yarn sensor means indicates that the calculated momentary position equals the real position of the withdrawal point of the yarn.

12. Apparatus as claimed in claim 9, wherein the yarn sensing means has only a single yarn sensor.

13. Apparatus as claimed in claim 9, wherein said calculating means includes a microprocessor.

* * * * *